US006120615A

United States Patent [19]

Fletcher

[11] Patent Number: 6,120,615

[45] Date of Patent: Sep. 19, 2000

[54] CENTRAL VACUUM SYSTEM

[76] Inventor: D. Chris Fletcher, 916 Glen Oak, Burleson, Tex. 76028

[21] Appl. No.: 09/298,022

[22] Filed: Apr. 22, 1999

Related U.S. Application Data

[60] Provisional application No. 60/082,627, Apr. 22, 1998.

[51] Int. Cl.[7] ..... A47L 9/24

[52] U.S. Cl. ..... 134/21; 15/315

[58] Field of Search ..... 15/301, 314, 315, 15/339; 134/21

[56] References Cited

U.S. PATENT DOCUMENTS

| | | | |
|---|---|---|---|
| 2,641,790 | 6/1953 | Coult . | |
| 3,353,996 | 11/1967 | Hamrick . | |
| 3,464,859 | 9/1969 | Hamrick . | |
| 3,520,725 | 7/1970 | Hamrick . | |
| 3,568,240 | 3/1971 | Hamrick . | |
| 3,911,944 | 10/1975 | Hukuba et al. | 15/314 |
| 3,958,297 | 5/1976 | Hukuba et al. . | |
| 3,977,037 | 8/1976 | Miyake et al. . | |
| 3,977,038 | 8/1976 | Hukuba et al. | 15/315 |
| 4,246,675 | 1/1981 | Costanzo . | |
| 5,114,050 | 5/1992 | Morris | 15/315 |
| 5,119,843 | 6/1992 | Keenan . | |
| 5,402,551 | 4/1995 | Workhoven et al. . | |
| 5,430,978 | 7/1995 | Kohler . | |
| 5,740,582 | 4/1998 | Harrelson . | |

*Primary Examiner*—Terrence R. Till
*Attorney, Agent, or Firm*—Felsman, Bradley, Vaden, Gunter & Dillon, LLP; James E. Bradley

[57] ABSTRACT

A central vacuum system is provided that has a permanently installed vacuum unit, which is preferably installed in a garage of a structure. A flexible hose is attached to a vacuum inlet on the vacuum unit and extends from the vacuum unit into an attic space in a structure. The flexible hose passes into a living space of a structure through a ceiling orifice. A retractor mechanism proximate the ceiling orifice is used to retrieve a length of the flexible hose from the living space and to deliver the flexible hose into the attic space for storage. A vertical hose guide is installed in the attic space. The vertical hose guide has a U-shaped bend on an upper end of the vertical hose guide to receive the flexible hose from the retractor mechanism and to deliver the flexible hose downwards onto a floor of the attic from a height above the floor.

12 Claims, 2 Drawing Sheets

CENTRAL VACUUM SYSTEM

CROSS-REFERENCE TO RELATED APPLICATIONS

This application claims the benefit of provisional application Ser. No. 60/082,627, filed on Apr. 22, 1998 in the U.S. Patent & Trademark Office.

TECHNICAL FIELD

This invention relates in general to a central vacuum system and in particular to a central vacuum system that has a retractable hose and that may be easily added to an existing structure.

BACKGROUND OF THE INVENTION

To avoid the difficulty and inconvenience of moving vacuum equipment around a living space, central vacuum systems have been developed. Central vacuum systems include a motorized suction fan and a dust collector, and an elongated flexible hose extending from the suction assembly. The hose normally has a handle at its distal end. Various accessories are typically proved for attachment to the handle.

Generally, central vacuum systems have a permanently located motorized suction fan, at least one vacuum hose outlet located near an area of living space to be vacuumed, and a conduit connecting the suction fan to the outlet. A flexible hose having a connection end and a handle end is releasably attached at its connection end to the outlet when the surrounding living space is to be vacuumed. Electrical wiring normally extends from the suction fan to the outlet and connects with other wiring extending through the hose to a control means in the handle of the hose, which completes an electrical control circuit.

Central vacuum systems have gained wide popularity and acceptance, particular in homes. However, one continuing annoyance is the need to store the vacuum hose when the system is not being used. Often, the problem is addressed by storing the hose in a closet, or carrying the hose to a remote area such as a garage. Such solutions are either inconvenient or unsightly.

Various means have been suggested by the related art to address this problem. For example, some patents describe central vacuum systems wherein the hose is inserted into the conduit joining the suction fan and the outlet when the hose is not in use. These patents include U.S. Pat. Nos. 3,353,996, 3,464,859, 3,520,725, and 3,568,240 to Hamrick, and U.S. Pat. No. 5,430,978 to Kohler.

Other patents describe devices that include a powered reel used to store the hose. These patents include U.S. Pat. No. 4,246,675 to Costanzo, U.S. Pat. No. 5,119,843 to Keerian, and U.S. Pat. No. 5,402,551 to Workhoven et al. Additional patents of possible relevance include U.S. Pat. No. 3,958, 297 to Hukuba et al., and U.S. Pat. No. 3,977,037 to Miyake et al.

U.S. Pat. No. 5,740,582 to Harrelson teaches a central vacuum hose storage unit that includes a storage compartment that can be positioned between the studs of the wall of a house or other structure so that the vacuum hose can be retracted into the compartment when not in use and withdrawn therefrom when it is to be used. A potential problem with the central vacuum hose storage system taught by Harrelson is that the storage system components are located in an inaccessible area that makes repair of components difficult.

Although the above discussed art provides some improvement over storage of a vacuum hose in a closet or garage, improvement is desired. A central vacuum system that retractably houses the hose of a central vacuum system that overcomes the above problems would be of considerable advantage and convenience to the home owner. Therefore, it is an object of the present invention to provide a central vacuum system having a method of hose storage that houses a flexible vacuum hose in a location that is convenient and unobtrusive.

SUMMARY OF THE INVENTION

A central vacuum system is provided that has a permanently installed vacuum unit. The vacuum unit is preferably installed in a garage of a structure, such as a residential home. The vacuum unit has an exhaust outlet and a vacuum inlet. The exhaust outlet of the vacuum unit preferably exhausts to an exterior of the structure. A flexible hose has a first end that is attached to a vacuum inlet on the vacuum unit and has a second end with a handle attached thereto that is grasped by an operator during use. The flexible hose extends from the vacuum unit into an attic space in a structure.

The flexible hose passes into a living space of a structure through a ceiling orifice. A retractor mechanism proximate the ceiling orifice is used to retrieve a length of the flexible hose from the living space and to deliver the flexible hose into the attic space for storage. The retractor mechanism preferably has a drive roller and a pinch roller pivotally mounted proximate the drive roller for selectively pinching the flexible hose between the pinch roller and the drive roller to facilitate engagement of the flexible hose with the drive roller.

A vertical hose guide is installed in the attic space. The vertical hose guide has a U-shaped bend on an upper end of the vertical hose guide to receive the flexible hose from the retractor mechanism and to deliver the flexible hose downwards onto a floor of the attic from a height above the floor.

BEST MODE FOR CARRYING OUT THE INVENTION

Figure 1:
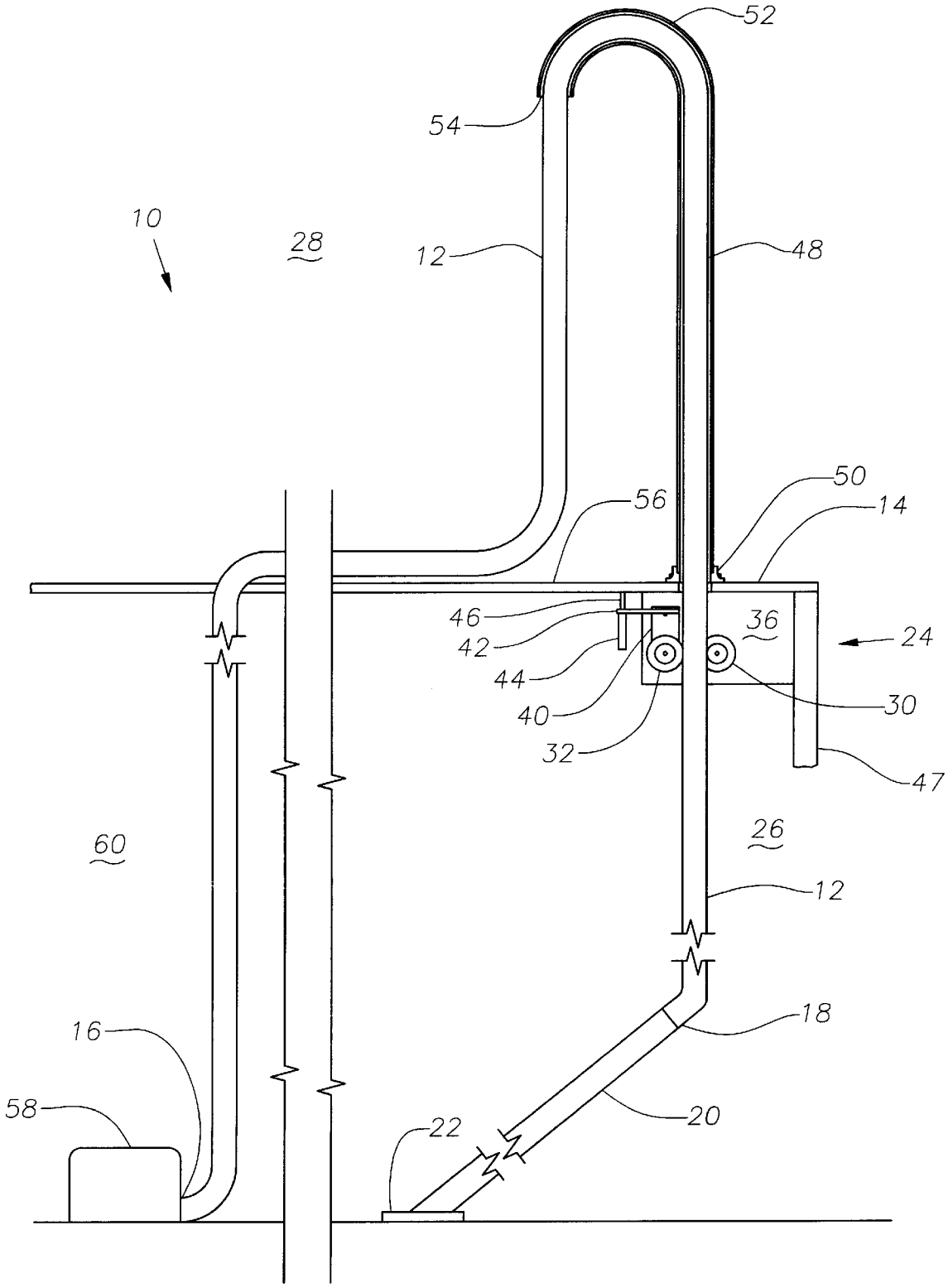
FIG. 1 is an elevation view of the central vacuum system in accordance with the invention.

Referring to FIG. 1, a central vacuum system is designated generally 10. Vacuum hose 12 extends from ceiling 14 of a structure such as a residential house. Vacuum hose 12 has first end 16 and terminal end 18. Removably affixed to terminal end 18 of hose 12 is handle 20 having vacuum head 22. In the preferred embodiment, vacuum head 22 is provided with an electrically powered beater bar that operates on 110 volts. In the preferred embodiment, hose 12 is 30 feet long and drops through ceiling 14, through retractor mechanism 24, and into closet 26. Preferably, a closet mounted retractor mechanism 24 and hose 12 is provided for every 1600 feet of living area.

Figure 2:
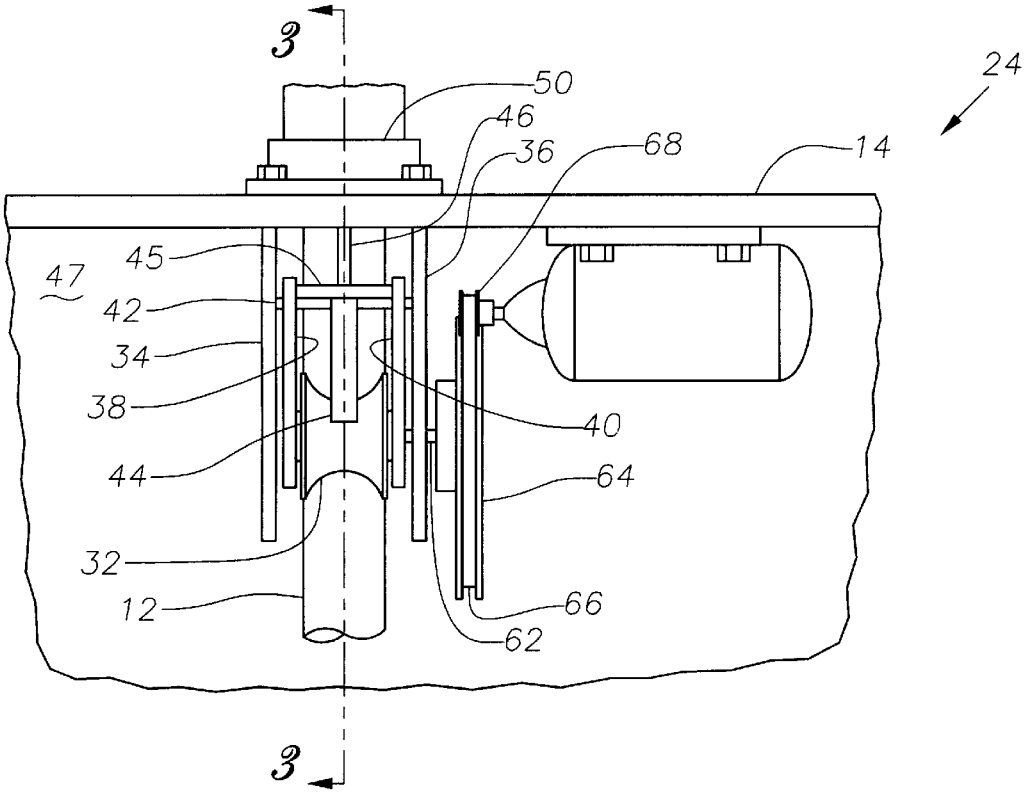
FIG. 2 is a side view of the retractor mechanism of the invention.

In the preferred embodiment, retractor mechanism 24 is mounted in an upper corner of closet 26 proximate wall 27. Retractor mechanism 24 engages hose 12 only for retraction of hose 12 into attic 28. Retraction mechanism includes drive roller 30 and pinch roller 32. In the preferred embodiment, pinch roller 32 is pivotally mounted between first brace 34 and second brace 36, as shown in FIG. 2. Preferably, pinch roller 32 pivots out of engagement with hose 12 when central vacuum system 10 is in use so that an operator may pull hose 12 manually downward through retractor mechanism 24.

Figure 3:
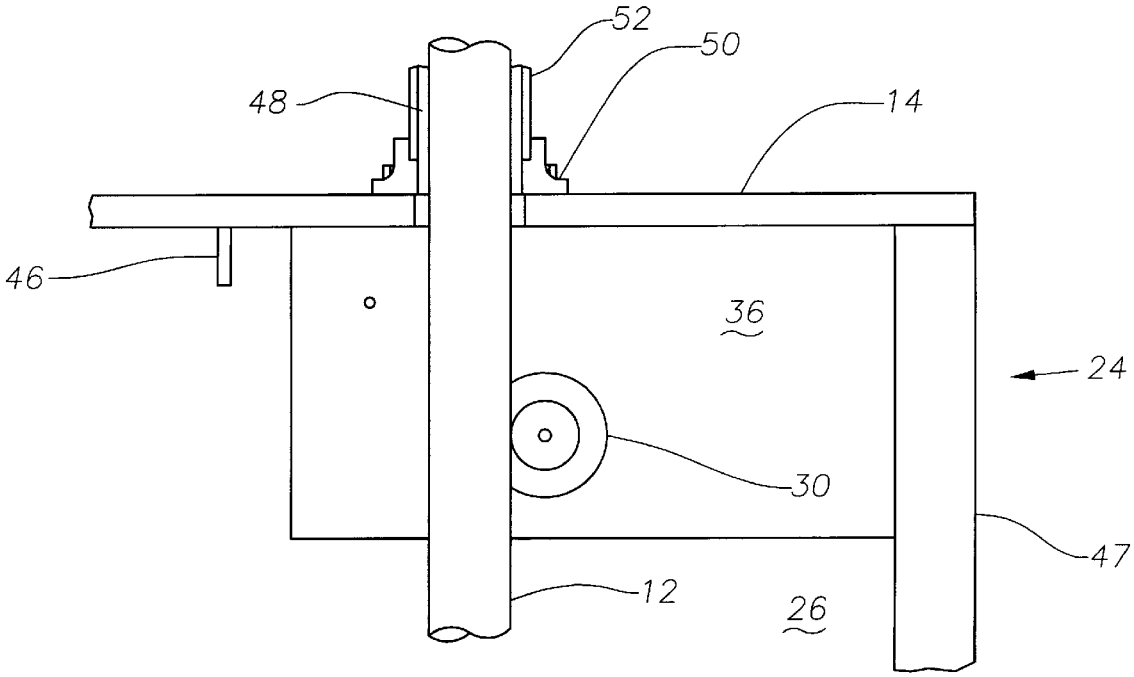
FIG. 3 is a front view of the retractor mechanism of the invention taken along line 3—3 of FIG. 2.

When central vacuum system 10 is no longer being used, an operator may manipulate a control mounted on handle 20 that communicates with central vacuum system 10 via a wire, which is preferably integrated in hose 12. By using the control, an operator may signal for pinch roller 32 to engage hose 12 and retract hose 12 into attic 28. In a preferred embodiment, pinch roller 32 is pivotally mounted between first pinch roller brace 38 and second pinch roller brace 40, as shown in FIG. 3. Pinch roller 32 pivots about pivot pin 42. Pinch roller 32 is held out of engagement with hose 12 by solenoid 44, which has solenoid plunger 45 pivotally mounted to ceiling 14. Energizing solenoid 44 causes it to extend and pivot pinch roller 32 away from hose 12 via pinch roller arm 46. When pinch roller 32 engages hose 12, retractor mechanism 24 pulls hose 12 into attic 28 with drive roller 30, powered by motor 47. Motor 47 rotates motor pulley 48, which is preferably operatively engaged with drive roller 30 by belt 66. Drive roller 30 pulls hose 12 into attic 28 and directs hose 12 into hose guide 49. Preferably, hose guide 49 is mounted in ceiling bracket 50 and extends upwards for several feet before making U-shaped bend 52 and terminating in hose guide open end 54. By forming U-shaped bend 52 on hose guide 49, hose 12 is directed substantially downwardly out of hose guide open end 54 where it spills out onto upper surface 56 of ceiling 14. By allowing hose 12 to pile up on upper surface 56 of ceiling 14, no reel is required to store retracted hose 12. It has been found that reeling and unreeling vacuum hose from a reel presents difficulties that are avoided by applicant's use of hose guide 49.

Hose 12 extends through ceiling 14 and communicates with vacuum 58 at first end 16 of hose 12. Preferably, vacuum 58 is positioned in a remote location such as garage 60. Vacuum 58 should be configured to exhaust outside. It is contemplated that, for a large structure, multiple hoses may emanate from vacuum 58 and service various areas of the structure.

Referring now to FIG. 2, a side view of retractor mechanism 24 is shown. Solenoid 44 is positioned beneath pinch roller arm 46 and plunger 45 is shown mounted to ceiling 14. Hose 12 is visible behind pinch roller 32. Pinch roller 32 is mounted between first pinch roller brace 38 and second pinch roller brace 40. Pinch roller braces 38 and 40, as well as pinch roller arm 46 and solenoid 44, pivot about pivot pin 42 so that pinch roller 32 may selectively engage hose 12. Pinch roller braces 38 and 40, pinch roller 32, pinch roller arm 45 and solenoid 44 are supported by pivot pin 42, which is mounted between first brace 34 and second brace 36. In a preferred embodiment, first brace 34 and second brace 36 are mounted on ceiling 14 and are affixed to ceiling bracket 50. Passing through second brace 36 is drive roller shaft 62. Drive roller shaft 62 is in communication with drive roller 30 as can be seen in FIG. 3, and with pulley 64. Pulley 64 is driven by belt 66, which is in communication with motor pulley 48. Motor pulley 48 is driven by motor 47, which is preferably affixed to ceiling 14.

Referring now to FIG. 3, shown is a front view of retractor mechanism 24 taken along line 3—3 of FIG. 2. Solenoid 44 is shown energized. Therefore, pinch roller arm 46 and pinch roller braces 38 and 40, which are visible in FIG. 2, are pivoted about pivot pin 42. As a result, pinch roller 32 is shown in engagement with hose 12. The pivoted or engaged position of pinch roller 32 allows drive roller 30 to retract hose 12 and force hose 12 through ceiling 14 and into hose guide 49, which is preferably positioned in attic 28. By activating a switch on handle 20, pinch roller 32 is directed to engage hose 12 and motor 47 is directed to rotate drive roller 30. The switch communicates with retractor mechanism 24 by a wire integrated in hose 12.

In practice, an operator desiring to vacuum a room opens a door to closet 26 and pulls hose 12 down through retractor mechanism 24. Solenoid 44, being retracted, holds pinch roller 32 away from hose 12, thereby allowing hose 12 to be easily pulled through ceiling 14. Hose 12 is piled up on upper surface 56 of ceiling 14 and may be pulled vertically upward into hose guide open end 54. Hose 12 bends around U-shaped bend 52 and may be pulled downwardly through the remainder of hose guide 49. The operator then affixes handle 20 to terminal end 18 of hose 12 whereupon vacuuming may begin by activating a switch on handle 20. Upon conclusion of vacuuming, retractor mechanism 24 may be activated by a switch on handle 20, which results in solenoid 44 extending. The extension of solenoid 44 results in pinch roller 32 pivoting about pivot pin 42 and engaging hose 12. Drive roller 30 may then retract hose 12 up through ceiling 14 and pile hose 12 on upper surface 56 of ceiling 14.

Advantages of this invention include enabling a simple installation of a central vacuum system within an existing structure. The equipment of the central vacuum system of the invention may be easily accessed for repair and maintenance. Additionally, unlike traditional central vacuum systems, an operator need not carry an extended length of hose from room to room for insertion into various wall jacks. Instead, only handle 20 need be carried so that handle 20 may be affixed to terminal end 18 of hose 12 for commencement of vacuuming. After completion of vacuuming, hose 12 easily and automatically retracts into attic 28, thereby eliminating the need to store sections of vacuum hose.

The invention has several advantages. One advantage is that the central vacuum system of the invention allows for convenient storage of the hose in an attic of a structure where the hose is in an unobtrusive location. An additional advantage is that all of the components of the invention are accessible for replacement or repair. Additionally, the central vacuum system of the invention may be installed in an existing structure.

While this invention has been shown in only one of its forms, it should be apparent to those skilled in the art that it is not so limited, but is susceptible to various changes without departing from the scope of the invention.

What is claimed is:

1. A central vacuum system for use in a dwelling having an attic space comprising:

a vacuum unit having an exhaust outlet and a vacuum inlet;

a flexible hose having a first end and a second end, said first end operatively connected to said vacuum inlet, said flexible hose adapted to extend from said vacuum unit within an attic space in a dwelling and out through a ceiling orifice provided to access a living space of the dwelling;

a retractor mechanism adapted to be mounted proximate said ceiling orifice for retrieving a length of said flexible hose from said living space and delivering said flexible hose into said attic space for storage; and a vacuum head on said second end of said hose.

2. The central vacuum system according to claim 1 further comprising:

a hose guide adapted to be mounted over the ceiling orifice, the hose guide receiving the hose and extending upward for delivery of said flexible hose onto a lower surface of said attic from a height above said lower surface.

3. The central vacuum system according to claim 1 further comprising:

a vertical hose guide having a U-shaped bend on an upper end of said vertical hose guide to deliver said flexible hose downwards onto a floor of said attic from a height above said floor.

4. The central vacuum system according to claim 1 wherein said retractor mechanism comprises:

a first roller;

a second roller pivotally mounted proximate said first roller for selectively pinching said flexible hose between said second roller and said first roller to facilitate engagement of said flexible hose with said first roller; and an electrical motor coupled to one of the rollers for selectively rotating said one of the rollers.

5. In a dwelling having a living space, a ceiling over the living space, an attic above the ceiling that has a lower surface, a central vacuum system comprising:

a vacuum unit having an exhaust outlet and a vacuum inlet;

a flexible hose having a first end and a second end, said first end operatively connected to said vacuum inlet, said flexible hose extending from said vacuum unit within the attic;

a ceiling orifice through which said flexible hose passes into the living space;

a retractor mechanism mounted proximate said ceiling orifice for retrieving a length of said flexible hose from said living space and delivering said flexible hose into said attic for storage;

a vertical hose guide mounted on said lower surface of said attic adjacent said ceiling orifice;

said hose guide extending upward above said lower surface of said attic to receive said flexible hose from said retractor mechanism and to deliver said flexible hose downwards onto said lower surface of said attic from a height above said lower surface; and a vacuum head on a second end of said hose.

6. The central vacuum system according to claim 5, wherein:

said hose guide has U-shaped head on an upper end.

7. The dwelling according to claim 5 wherein:

said exhaust outlet of said vacuum unit exhausts to an exterior of said dwelling.

8. The central vacuum system according to claim 5 wherein said retractor mechanism comprises:

a first roller;

a second roller pivotally mounted proximate said first roller for selectively pinching said flexible hose between said second roller and said first roller to facilitate engagement of said flexible hose with said first roller; and an electrical motor coupled to one of the rollers for selectively rotating said one of the rollers.

9. A method of vacuuming a dwelling having a living space, a ceiling over the living space, an attic above the ceiling that has a lower surface, comprising the steps of:

installing a vacuum unit having an exhaust outlet and a vacuum inlet;

affixing a flexible hose having a first end and a second end to said vacuum inlet; extending said flexible hose from said vacuum unit into the attic;

providing a ceiling orifice in the attic and feeding said flexible hose through a ceiling orifice into the living space of the dwelling;

operating said vacuum and vacuuming the living space with said flexible hose; and retracting a length of said flexible hose from said living space through said ceiling orifice and delivering said flexible hose into said attic for storage.

10. The method of vacuuming a dwelling according to claim 9 further comprising the steps of:

mounting a hose guide in said attic, said hose guide extending upward from said ceiling orifice;

running said flexible hose through said hose guide; and wherein said step of retracting comprises delivering said flexible hose downwards from said hose guide onto a lower surface of said attic from a height above said lower surface.

11. The method of vacuuming a dwelling according to claim 9 wherein:

said step of retracting comprises rotating rollers in contact with said hose.

12. The method of vacuuming a structure according to claim 9 further comprising:

exhausting said vacuum unit to an exterior of said dwelling.

* * * * *